US010477314B2

(12) United States Patent
Trammel et al.

(10) Patent No.: US 10,477,314 B2
(45) Date of Patent: Nov. 12, 2019

(54) DYNAMIC AUDIO ENHANCEMENT USING AN ALL-PASS FILTER

(71) Applicant: Bambu Tech, Inc., Calabasas, CA (US)

(72) Inventors: Earnest Lloyd Trammel, Thousand Oaks, CA (US); John Raymond Gould, Moorpark, CA (US)

(73) Assignee: BAMBU TECH, INC., Calabasas, CA (US)

( * ) Notice: Subject to any disclaimer, the term of this patent is extended or adjusted under 35 U.S.C. 154(b) by 49 days.

(21) Appl. No.: 15/922,145

(22) Filed: Mar. 15, 2018

(65) Prior Publication Data

US 2018/0270574 A1 Sep. 20, 2018

Related U.S. Application Data

(60) Provisional application No. 62/473,963, filed on Mar. 20, 2017.

(51) Int. Cl.
*H04R 3/04* (2006.01)
*H04R 1/22* (2006.01)

(52) U.S. Cl.
CPC ..... *H04R 3/04* (2013.01); *H04R 1/22* (2013.01); *H04R 2499/13* (2013.01)

(58) Field of Classification Search
CPC ..... H04R 3/04; H04R 1/22; H04R 2499/13; H04R 25/43
USPC ..... 381/119, 121, 97, 96, 120, 56, 58
See application file for complete search history.

(56) References Cited

U.S. PATENT DOCUMENTS

| | | | | |
|---|---|---|---|---|
| 4,184,047 | A | 1/1980 | Langford | |
| 4,594,730 | A * | 6/1986 | Rosen | H04S 3/00 381/18 |
| 4,873,722 | A | 10/1989 | Tominari | |
| 4,908,858 | A | 3/1990 | Ohno | |
| 4,947,133 | A | 8/1990 | Thomas | |
| 5,027,410 | A | 6/1991 | Williamson et al. | |
| 5,230,022 | A | 7/1993 | Sakata | |
| 5,668,884 | A | 9/1997 | Clair, Jr. et al. | |
| 5,771,299 | A | 6/1998 | Melanson | |
| 5,822,440 | A | 10/1998 | Oltman et al. | |
| 6,507,657 | B1 | 1/2003 | Kamada et al. | |
| 6,865,430 | B1 | 3/2005 | Runton et al. | |
| 8,229,135 | B2 | 7/2012 | Sun et al. | |
| 8,538,037 | B2 | 9/2013 | Herre et al. | |
| 8,705,764 | B2 | 4/2014 | Baritkar et al. | |
| 8,934,641 | B2 | 1/2015 | Avendano et al. | |

(Continued)

OTHER PUBLICATIONS

Ambede, A., "Design and Implementation of High-Speed All-Pass Transformation-Based Variable Digital Filters by Breaking the Dependence of Operating Frequency on Filter Order." IEEE Transactions on Very Large Scale Integration (VLSI) Systems, May 2016, pp. 2008-2012, vol. 24, No. 5. USA.

(Continued)

*Primary Examiner* — Thjuan K Addy
(74) *Attorney, Agent, or Firm* — Womble Bond Dickinson (US) LLP

(57) ABSTRACT

An input audio signal is all-pass filtered and scaled, before being combined with an original version of the input audio signal, to produce an output signal. Envelope of the input signal is detected and the all-pass filter is altered dynamically or in real time, as a function of the detected envelope. Other embodiments are also described and claimed.

21 Claims, 13 Drawing Sheets

(56) References Cited

U.S. PATENT DOCUMENTS

| | | | | |
|---|---|---|---|---|
| 2006/0008101 | A1 | 1/2006 | Kates | |
| 2008/0044038 | A1* | 2/2008 | Houle | H04S 1/002 381/97 |
| 2015/0003633 | A1 | 1/2015 | Trammell | |

OTHER PUBLICATIONS

Darak, Sumit J., Efficient implementation of reconfigurable warped digital filters with variable low-pass, high-pass, bandpass, and bandstop responses. IEEE Transactions on Very Large Scale Integration (VLSI) Systems, 2013, pp. 1165-1169, vol. 21, No. 6, USA.

Intersil Corporation, "An Introduction to Digital Filters—Application Note (AN9603.2)." Jan. 1999, 10 pages.

Puckette, M., "The Theory and Technique of Electronic Music." World Scientific Publishing Co. Pte. Ltd., Draft—Dec. 30, 2006, 337 pages.

Regalia, et al., "The Digital All-Pass Filter: A Versatile Signal Processing Building Block." Proceedings of the IEEE, Jan. 1988, pp. 19-37, vol. 76, No. 1, USA.

* cited by examiner

DYNAMIC AUDIO ENHANCEMENT USING AN ALL-PASS FILTER

FIELD

An embodiment of the invention is generally related to audio signal processing techniques that are intended to enhance the quality of an audio signal in terms of how it sounds during playback. Other embodiments are also described.

BACKGROUND

The search for audio signal processing techniques and sound systems that can reproduce sound with higher quality continues in the modern age. An original, high quality audio signal often becomes degraded due to manipulations applied to it for purposes of storage and transmission. The problem of poor quality sound during playback is especially acute when the original audio signal has undergone lossy compression to reduce its bit rate, for purposes of either reduced storage requirements or to meet reduced transmission bandwidth over the Internet.

The quality of an encoded and then decoded (codec processed) audio signal may be improved by digital signal processing of the codec-processed signal, seeking to harmonically enhance and frequency equalize the signal. A digital filter can be designed to reshape the phase and frequency content of the codec processed audio signal that is passed through it, in hopes of recovering the lost realism (as experienced during its playback.) In another approach, the use of an all-pass filter has been suggested, which is a signal-processing block that passes all frequencies equally in terms of gain or magnitude, but changes the phase relationship between various frequencies. In an all-pass filter, the phase shift between the output and the input varies as a function of frequency. An all-pass filter may be described by the frequency at which its phase shift crosses 90° or when the input and output signals are described as going into quadrature or when there is a quarter wavelength of delay between the output and the input. All-pass filters are often used to compensate for undesired phase shifts that have arisen in an audio system. An all-pass filter may be implemented in a myriad of ways, as a digital infinite impulse response (IIR) filter whose difference equation has the well-known general form $$y(n) = \sum_{i=0}^{N} a_i x(n-i) - \sum_{i=1}^{N} b_i y(n-i)$$

The efficacy of any codec-processed audio signal enhancement technique may be judged by comparing the spectral content of the enhanced audio signal to the original audio signal, or it may be judged in view of the improvement in how the enhanced audio signal sounds during playback.

SUMMARY

An embodiment of the invention is a digital audio signal enhancement technique, for processing an input audio signal so as to produce an output audio signal that may have improved quality in how it sounds during playback, in terms of a fuller or richer sound, or manifestly as a more realistic sound. The output audio signal may then be encoded using a lossy compression algorithm (for bit rate reduction), and then subsequently decoded in preparation for playback. The enhancement technique in that case is a pre-processing operation, which enables the subsequent, codec processed version of the audio signal to maintain a more complete audio spectrum (as compared to the situation where the codec processed signal had been produced without the enhancement technique having been applied as a pre-processing operation.) In particular, the pre-processing may advantageously prevent an upper frequency content of the codec processed audio signal from being suppressed.

In another embodiment of the invention, an input audio signal is split into its low and high frequency portions, before being fed to respective, enhancement processing blocks, in parallel. The outputs of these two enhancement processing blocks may then be combined, by a summing unit.

The enhancement processing may be duplicated for each of the typical left and right channels of a stereo audio signal, where each channel is enhanced separately without contributions from the other channel.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
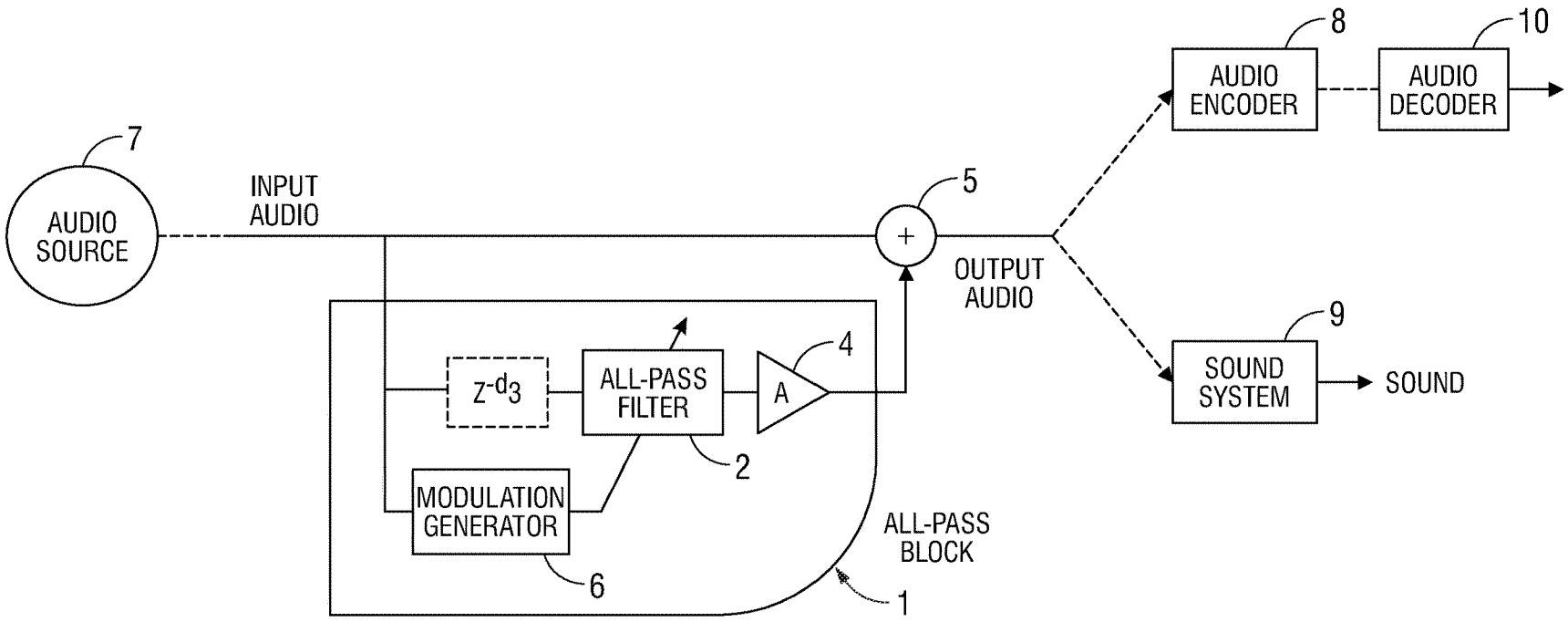
FIG. 1 is a block diagram of a digital audio signal processor that has an all-pass block.

FIG. 1 is a block diagram of a digital audio signal processor that has an all-pass block 1 which filters an input audio signal, to produce an all-pass filtered version at an input of a summing unit 5. As part of the all-pass block 1, there is an all-pass filter 2 having an input that receives the input audio signal, and a control input through which its phase response is varied. The control input is coupled to an output of a modulation generator 6 which also receives the input audio signal. In one embodiment, the inputs to the modulation generator 6 and the all-pass filter 2 are the same input audio signal, while in other embodiments there may be a delay element $Z^{-d^3}$ (as shown in dotted lines in FIG. 1) added in front of the all-pass filter 2 (and not in front of the modulation generator 6). The optional delay elements may present static delays (e.g., fixed, while the all-pass filter 2 is being dynamically altered by the modulation generator 6). The output of the all-pass filter 2 is scaled to produce a scaled, all-pass filtered version, by a gain element 4. The signal from the output of the all-pass block 1 is combined at the summing unit 5 with the input audio signal, bypassing the all-pass block 1. The output of the summing unit 5 thus produces an output audio signal, which is an enhanced version of the input audio signal, enhanced for improved realism.

The input audio signal may be produced, as a digital audio signal, by an audio source 7, such as a digital media player program that is stored in memory and is being executed by a processor; the processor and memory may be part of a server, or they may be part of a consumer electronics end user device such as a smartphone, laptop computer, or in-vehicle infotainment system. A link between the audio source 7 and the all-pass block 1 may include a digital communications path through the Internet or through a cellular telephone network, for example. In another embodiment, the connection between the audio source 7 and the all-pass block 1 may lie entirely within a server, for example as part of a media server that is producing the output audio signal which is being streamed over the Internet; in that case, the output audio signal may be encoded by an audio encoder 8 for purposes of bit rate reduction, e.g., the audio encoder 8 may implement a lossy compression algorithm. Subsequent to the encoding, there is a corresponding decoding operation performed by an audio decoder 10 that undoes the encoding performed by the audio encoder 8. The decoder 10 may be part of a consumer electronics end user device (a client or playback device) such as a smartphone, laptop computer, or in-vehicle infotainment system. The "channel" between the output of the audio encoder 8 and the input of the audio decoder 10 may include a path through the Internet or other digital communications network, including for example a cellular telephone network. It may also, or instead, be a storage device such as a cloud-based mass storage. In another embodiment, the output audio signal may be converted by a sound system 9 into sound, e.g., as part of a consumer electronics end user (client or playback) device, where in that case the all-pass block 1 and the summing unit 5 could be implemented within the same consumer electronics device of which the sound system 9 is a part, e.g., a smartphone, laptop computer, or in-vehicle infotainment system.

Still referring to FIG. 1, the modulation generator 6 may serve to detect envelope of the input audio signal, while the input audio signal is being filtered by the all-pass filter 2 and scaled by the gain element 4 before being combined by the summing unit 5. The modulation generator 6 in one embodiment may be an envelope follower or envelope detector implemented using digital signal processing that computes a moving average of the amplitude of the input audio signal. The detected envelope (as the computed moving average) may be updated at a rate of between every sample to every 10 (ten) samples of the input audio signal. The moving average may be computed for a window of samples of the input audio signal, where the window may have a length in a range of 1 (one) sample to 50 (fifty) samples, regardless of sample rate. Note that the term "average" is used generically here, to refer to any measure of central tendency, which includes the arithmetic mean of the samples just as an example, as other ways of computing the measure of central tendency are possible; the term "amplitude" is also defined generically here to refer to for example peak-to-peak amplitude, or root means square (RMS) amplitude.

Figure 2:
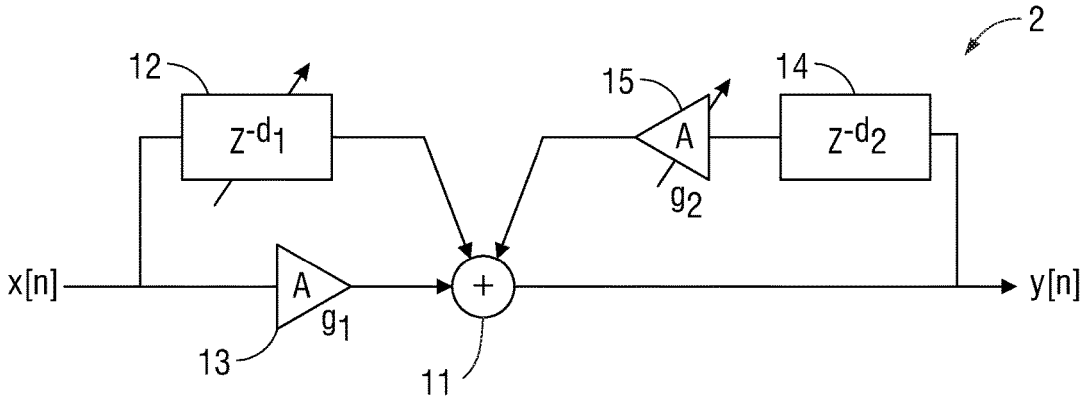
FIG. 2 is a signal flow diagram of an example, all-pass filter that is part of the all-pass block.

The detected envelope (by the modulation generator 6) is used to alter the all-pass filter 2 "dynamically" or in real-time. The all-pass filter 2 is thus a time-varying digital filter that is being updated by the modulation generator 6, for example at a rate of every sample, or a little slower, e.g., up to every ten (10) samples, of the input audio signal. An example of the all-pass filter 2 is depicted by a signal flow diagram in FIG. 2. There is a filter input at which x[n] represents the input sequence (input audio signal), and a filter output at which y[n] is the output sequence. A summing junction 11 has a first input that receives an un-delayed version of the filter input x[n] through a feedforward gain element 13 having a scalar gain $g_1$, and a second input that receives a delayed version of the filter input x[n], by virtue of the input sequence x[n] passing through a feedforward delay element 12 having a first delay d1. The summing junction 11 has a third input that receives a delayed version of the filter output y[n], by virtue of passing the filter output signal y[n] through a feedback delay element 14 having a second delay d2. The phase response of the all-pass filter 2 is time-varying, due to the variable, first delay d1 which represents a number of samples by which the delayed version of the filter input is delayed (by the feedforward delay element 12). This is indicated in FIG. 2 by the z transform nomenclature, $z^{-d_1}$ which represents the transfer function of the delay element 12. The time-varying phase response of the all-pass filter 12 is also due to the changeable scalar gain, $g_2$, which is the gain that is applied to the delayed version of the filter output by a feedback gain element 15.

In one embodiment, those two time-varying elements, namely the delay element 12 and the gain element 15, are the only time-varying elements of the all-pass filter 2 that are being updated dynamically or in real-time in accordance with the detected envelope; the scalar gain $g_1$ of the feed-forward gain element 13 and the second delay d2 presented by the feedback delay element 14 may remain fixed or static (in relation to the dynamically variable first delay $d_1$ and scalar gain $g_2$). In other words, the phase response of the all-pass filter 2 is changing due to variations in d1 and g2 which are dynamically controlled by the modulation generator 6 (see FIG. 1), while the delay presented by the delay element 14 and the gain applied by the gain element 13 are not changing. Of course, it should be recognized that the static parameters $g_1$ and $d_2$ may still be changed to suit a particular "tune" of the all-pass block 1, in view of the particular application of the enhancement pre-processing, such as the type of input audio signal (e.g., determined based on the particular elements of an uplink communications audio signal processing chain that also acts on the input audio signal and that precedes or follows the pre-processing.) The static tune of the all-pass block 1 may also be set based on the expected subsequent or downstream processing that will be performed upon the output audio signal (e.g., codec processing, or rendering for playback such as dynamic range control and equalization.) The static parameters may be tuned during for example, laboratory testing of the all-pass block 1 in view of the particular type of input audio signal, including for example its dynamic range or the expected subsequent processing that is performed on the output audio signal, e.g., a particular type of codec processing or a particular sound system used for playback.

The first delay $d_1$, which may refer to the number of samples by which the filter input x[n] is delayed by the delay element 12, is variable between a minimum delay (lower bound) and a maximum delay (upper bound), in proportion to the detected envelope of the input audio signal x[n]. Said another way, the all-pass filter 2 is modulated in a dynamic manner, by the modulation generator 6 which is detecting the envelope of x[n], so that the first delay $d_1$ becomes longer in proportion to or in response to the detected envelope increasing, shorter in proportion to or in response to the detected envelope decreasing. For example, if the minimum delay is set to "0" and the maximum delay to "10", and the envelope or level of the input signal is at 50% of the maximum level allowed, then the first delay $d_1$ is set to be "5". This number representing the first delay $d_1$ varies in real time, according to the input signal x[n]. In one embodiment, the modulation generator 6 is designed to set the first delay $d_1$ to "0" (the minimum delay) when the level of the input audio signal is "lowest", which may be when the input audio signal is at some minimum threshold level above a noise floor. In addition, in one embodiment, the modulation generator 6 is designed to be independent of the user volume setting (that may be "manually" changed by a user of a playback device to change the loudness of the sound produced by the sound system 9—see FIG. 1).

In one embodiment, the feedback gain $g_2$ that is applied to the delayed version of the filter output (at the third input of the summing junction 11) is also variable (between a minimum gain and a maximum gain), in proportion to the detected envelope of the input audio signal. For example, the feedback gain $g_2$ increases responsive to the detected envelope increasing, and decreases responsive to the detected envelope decreasing. In one embodiment, the same detected envelope may trigger both a change in the feedback gain $g_2$ and a change in the first delay $d_1$.

Figure 3A:
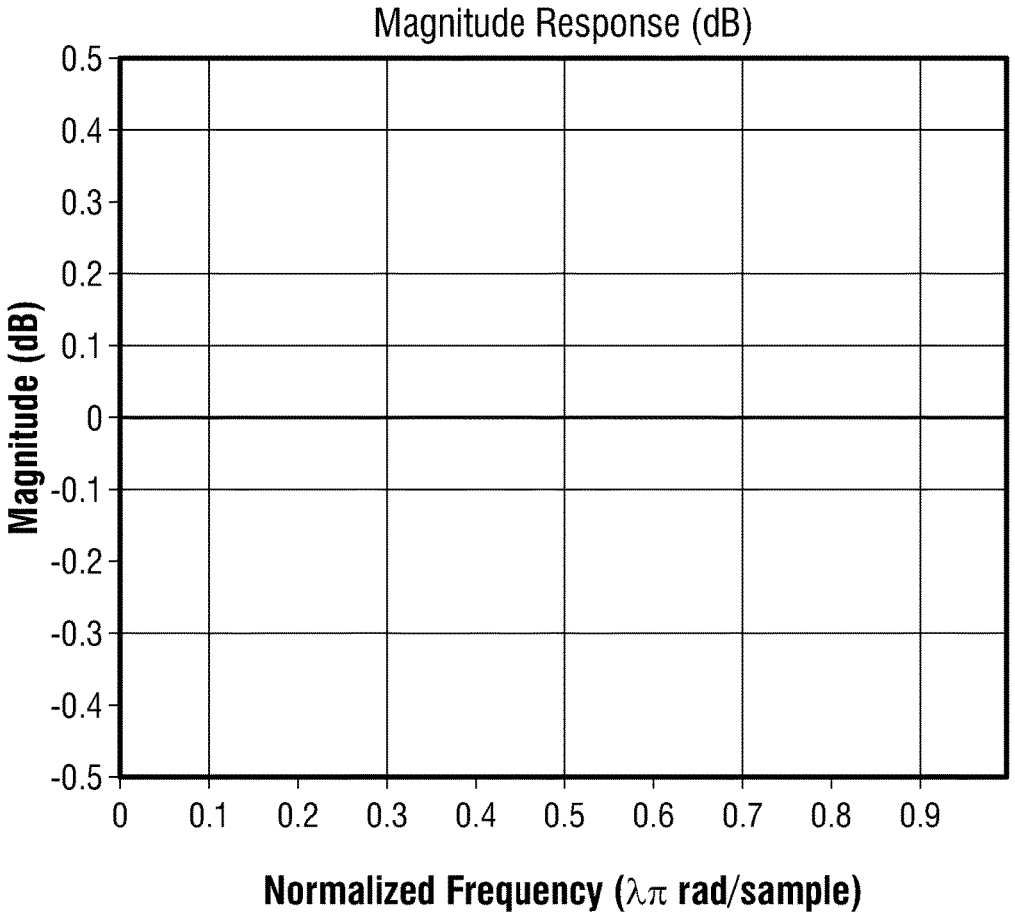
FIG. 3*a* illustrates the magnitude response of an example of the all-pass filter shown in FIG. 2.
Figure 3B:
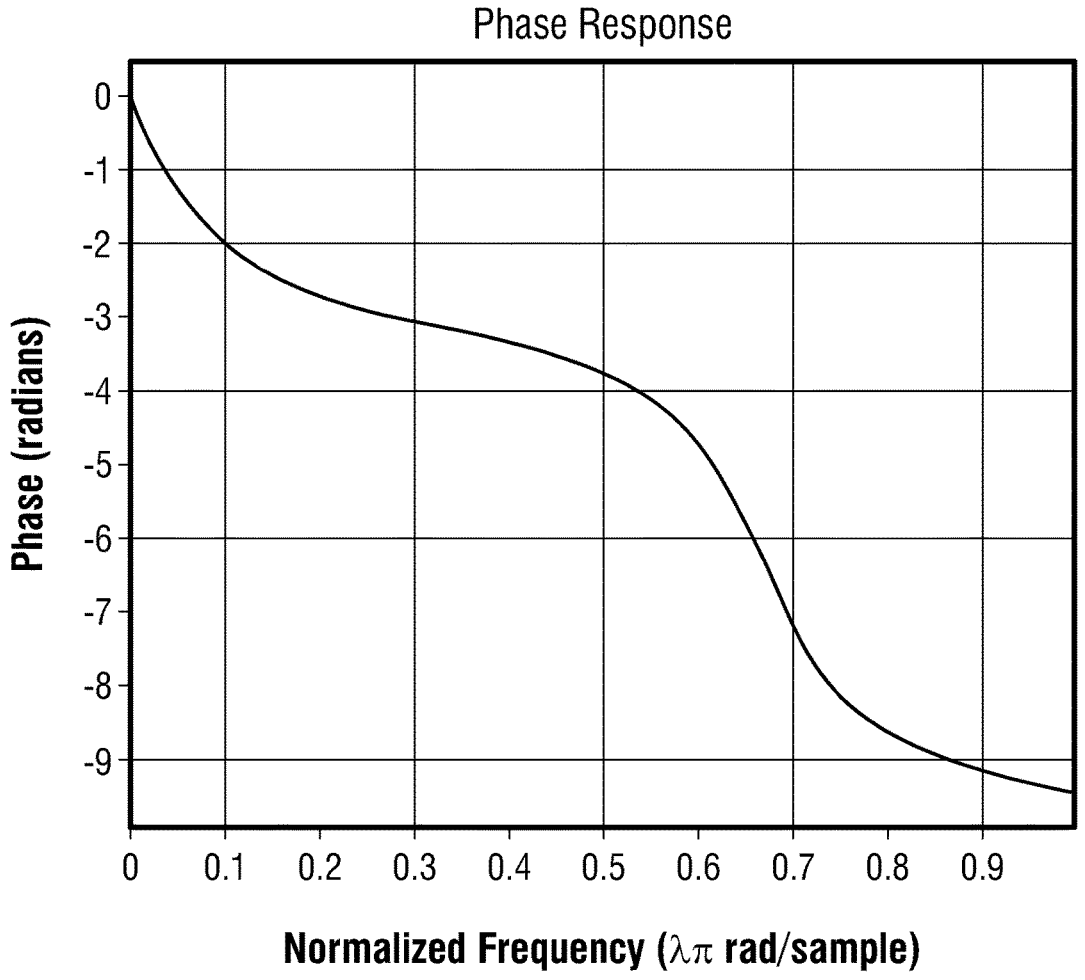
FIG. 3*b* shows the phase response of the example of the all-pass filter.
Figure 4A:
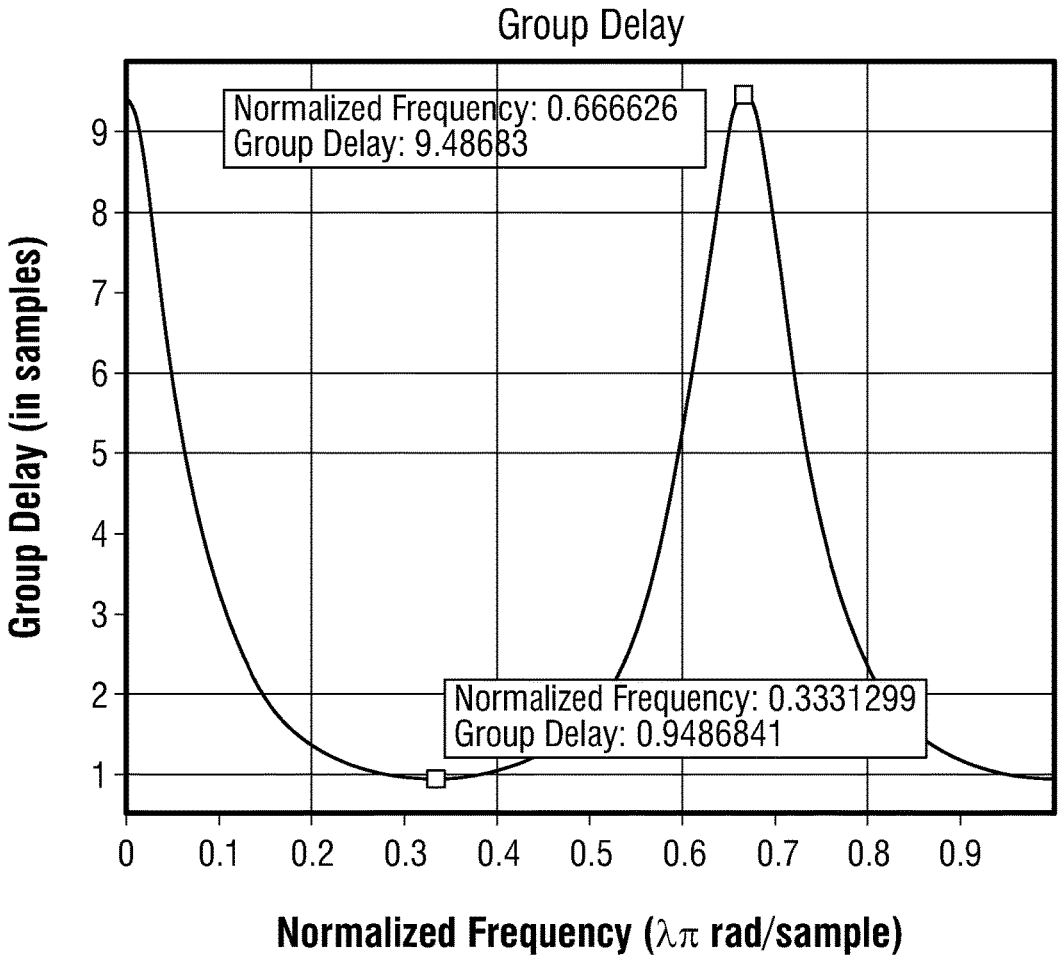
FIG. 4*a* shows the group delay of the example of the all-pass filter.
Figure 4B:
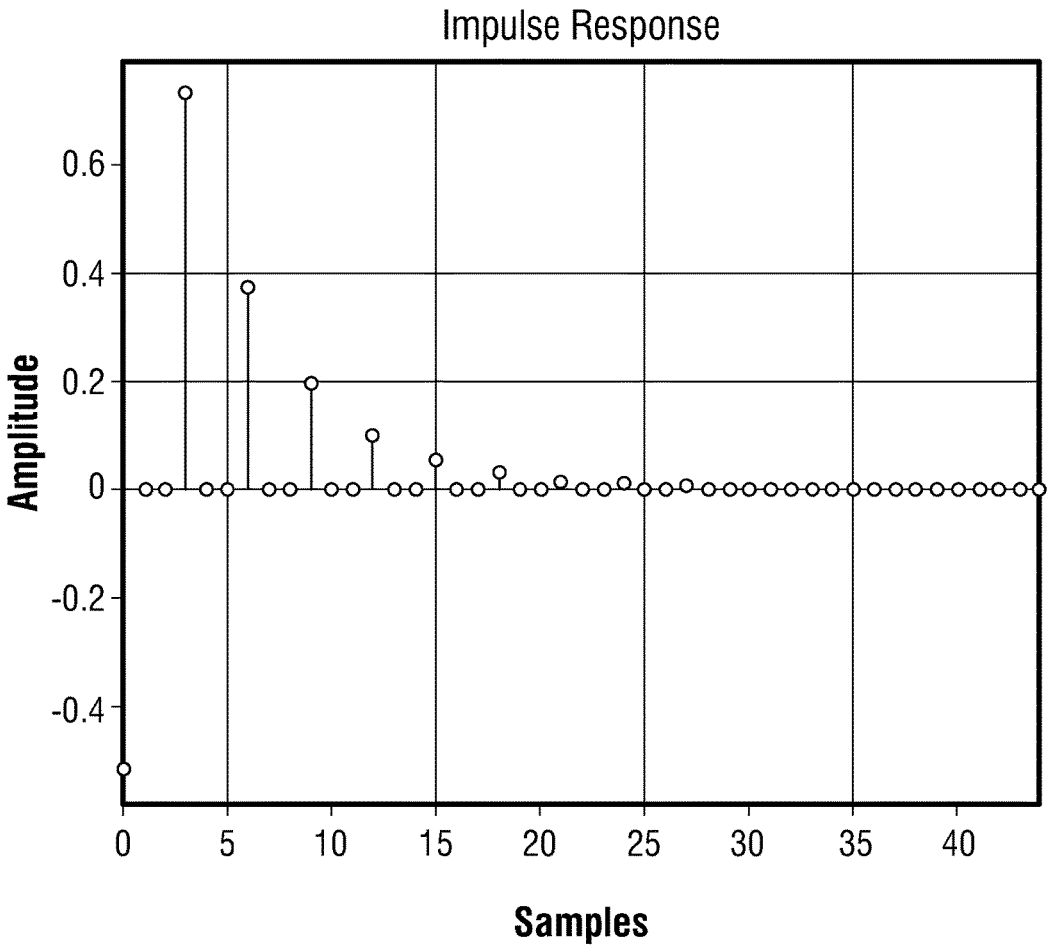
FIG. 4*b* shows the impulse response of the example of the all-pass filter.

FIG. 3*a* illustrates the magnitude response of an example of the all-pass filter shown in FIG. 2 in which minimum delay=1 and maximum delay=10. FIG. 3*b* shows its phase response, FIG. 4*a* shows its group delay, and FIG. 4*b* shows its impulse response.

Figure 5:
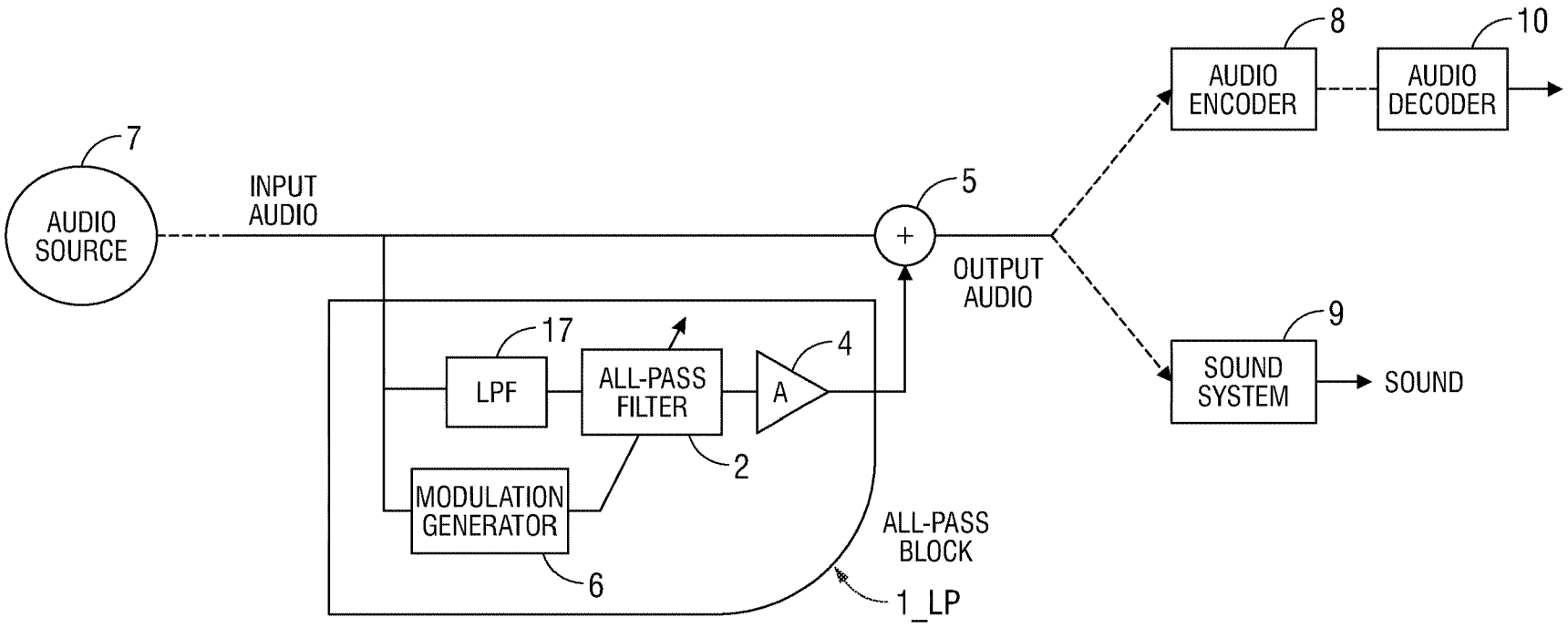
FIG. 5 is a block diagram of another signal enhancement technique that uses a low-pass version of the all-pass block in FIG. 1.

Turning now to FIG. 5, this is a block diagram of another signal enhancement technique in which a low-pass focused all-pass block 1_LP is used to produce the audio output signal. The block 1_LP is a low-pass focused version of the all-pass block 1 of FIG. 1, where the input audio signal x[n] is low-pass filtered to produce a low-pass filtered version, by the low-pass filter, LPF, 17, which is then input to the all-pass filter 2. Said another way, the LPF 17 has an input to receive x[n] (optionally delayed as shown in FIG. 1), and an output that feeds the input of the all-pass filter 2. The LPF 17 is thus in front of the all-pass filter 2, and not in front of the modulation generator 6.

Figure 6:
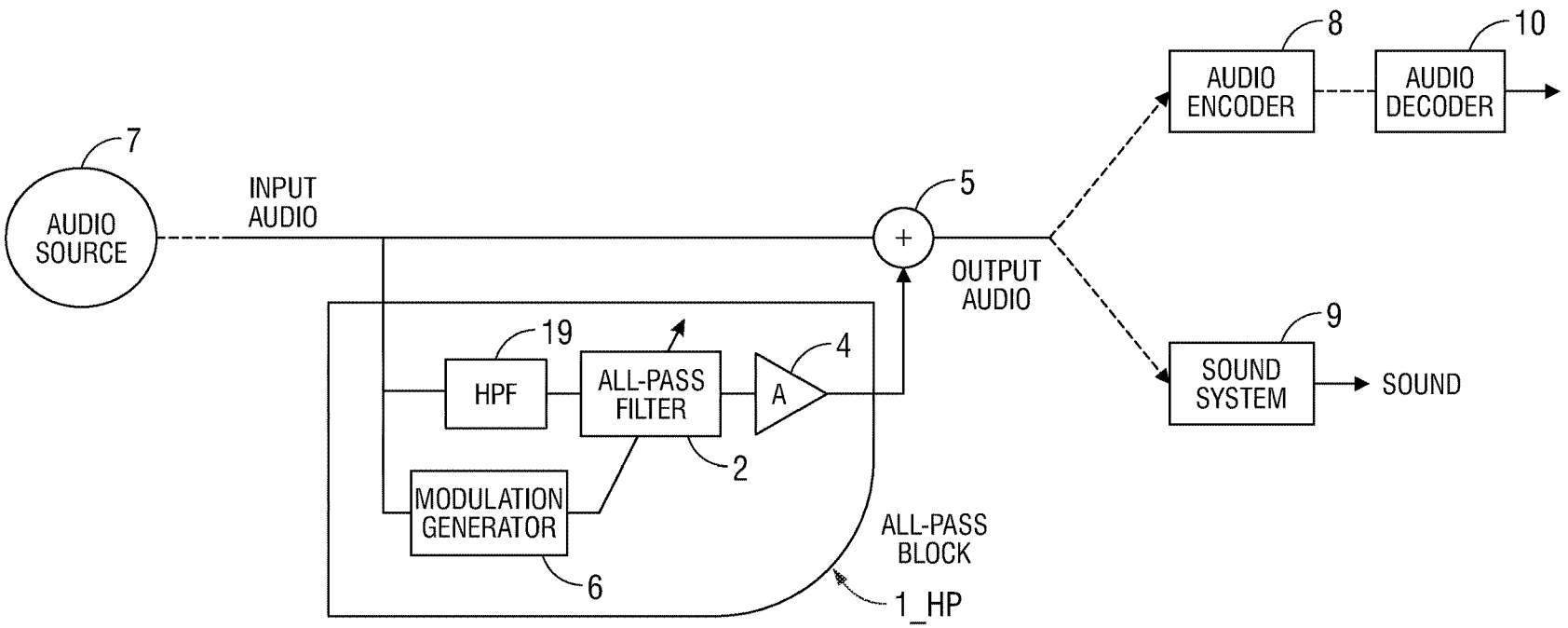
FIG. 6 illustrates a high-pass version of the all-pass block of FIG. 1.

In FIG. 6, a high-pass focused all-pass block 1_HP is used to produce the audio output signal. In the all-pass block 1_HP, instead of the LPF 17 a high-pass filter, HPF, 19 is inserted in front of the all-pass filter 2 (and not in front of the modulation generator 6). Note how in both FIG. 5 and FIG. 6, the input to the modulation generator 6 remains the unfiltered input audio signal x[n], and also how the unfiltered input audio signal while bypassing the all-pass block 1_LP or 1_HP is still combined with the scaled output of the all-pass filter 2 at the summing unit 5.

Figure 7:
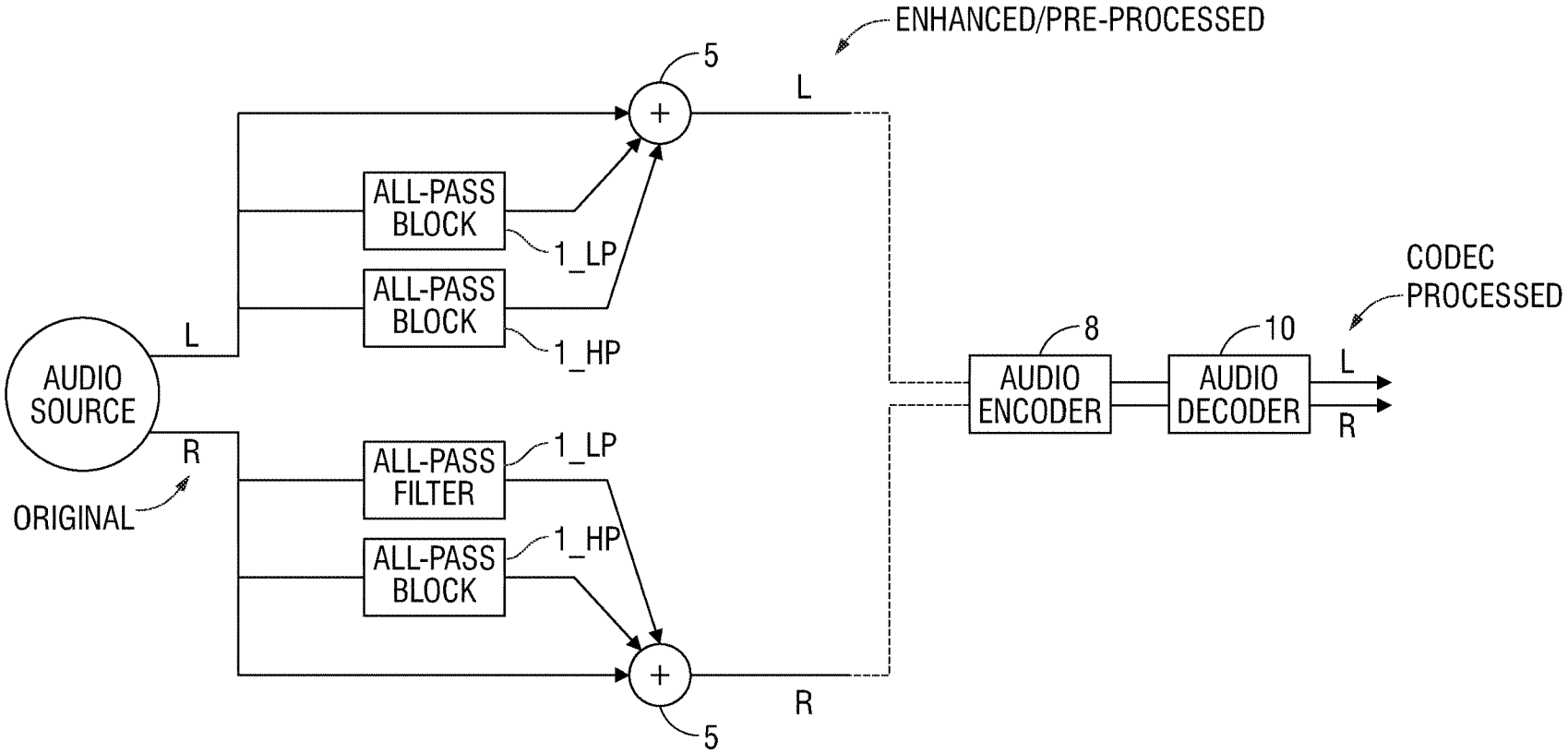
FIG. 7 shows an example, multi-channel application of the signal enhancement technique, where a left-channel and a right-channel are separately pre-processed by respective all-pass blocks, before being codec processed.

Turning now to FIG. 7, a multi-channel application of the audio signal enhancement technique is shown, in which each of a left-channel L and a right-channel R is separately pre-processed by a respective pair of all-pass blocks 1_LP, 1_HP and combined at the summing unit 5. The enhanced or pre-processed L and R audio output signals (at the output of the pair of summing units 5, respectively), are then codec processed, by the audio encoder 8 and the subsequent audio decoder 10. For each of the L and R input channels, there are two all-pass blocks, namely all-pass block 1_LP as depicted in FIG. 5, and all-pass block 1_HP as depicted in FIG. 6, both of which operate on the same input audio signal. The input audio signal is split three ways so that it is processed in parallel through three paths, namely the two all-pass blocks 1_LP, 1_HP and a bypass path. The outputs of the three paths are combined, by the summing unit 5, to produce the respective L or R enhanced or pre-processed channel.

Figure 8:
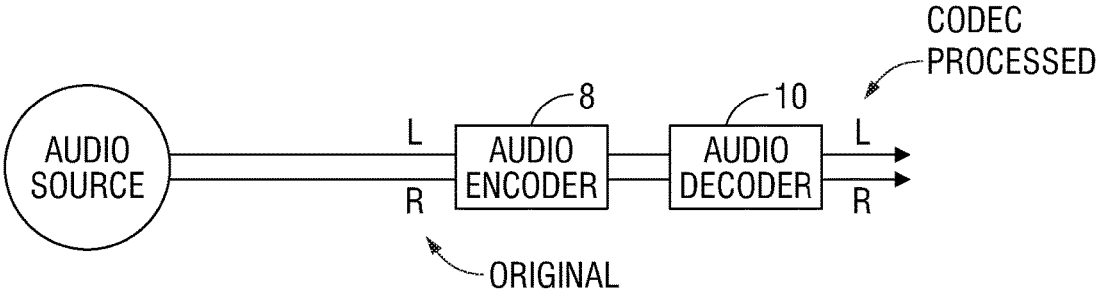
FIG. 8 illustrates a conventional codec process being performed upon an original, stereo audio signal.
Figure 9:
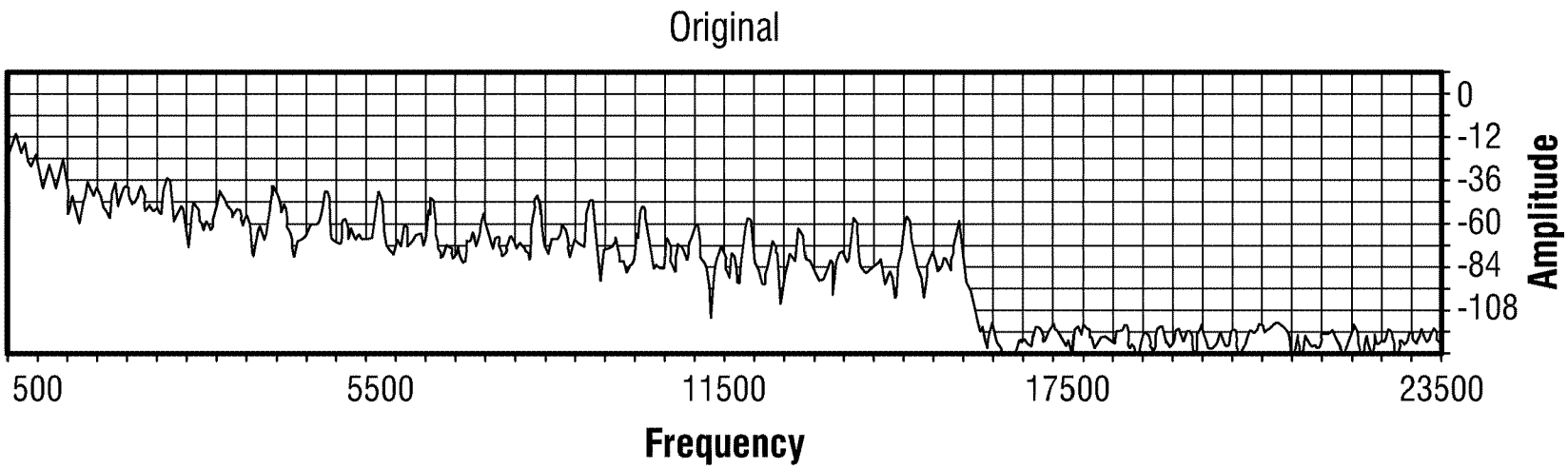
FIG. 9 is a graph of the magnitude spectrum of an example, original audio signal.
Figure 10:
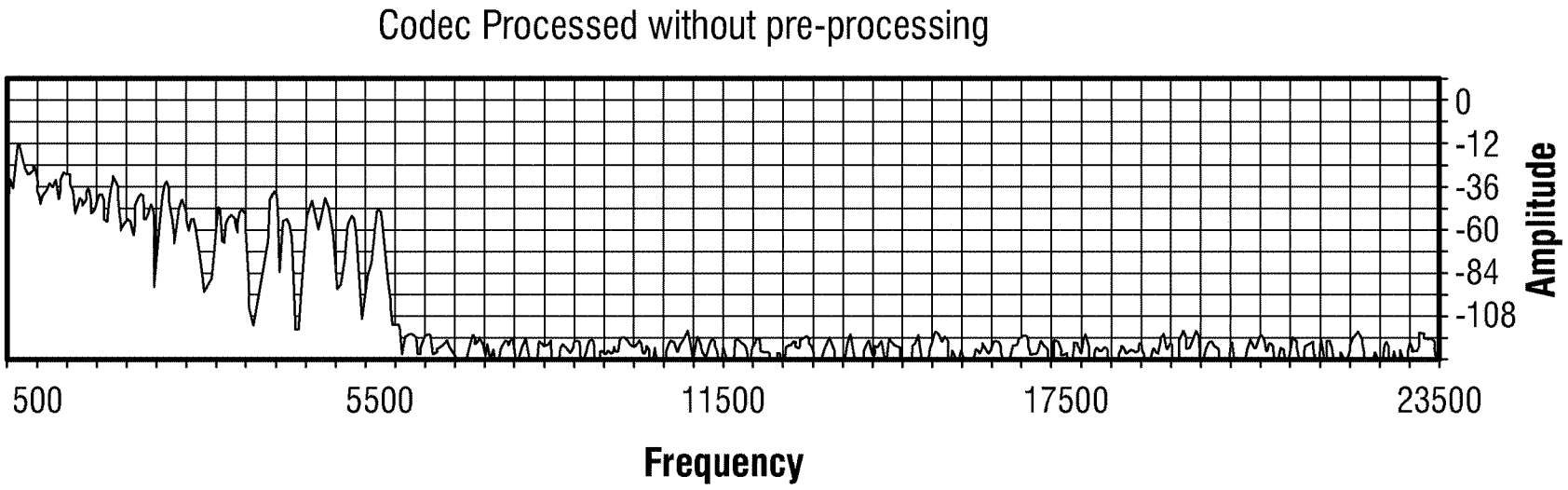
FIG. 10 is a magnitude spectrum of a codec-processed version of the original signal of FIG. 9, without pre-processing of the original signal.
Figure 11:
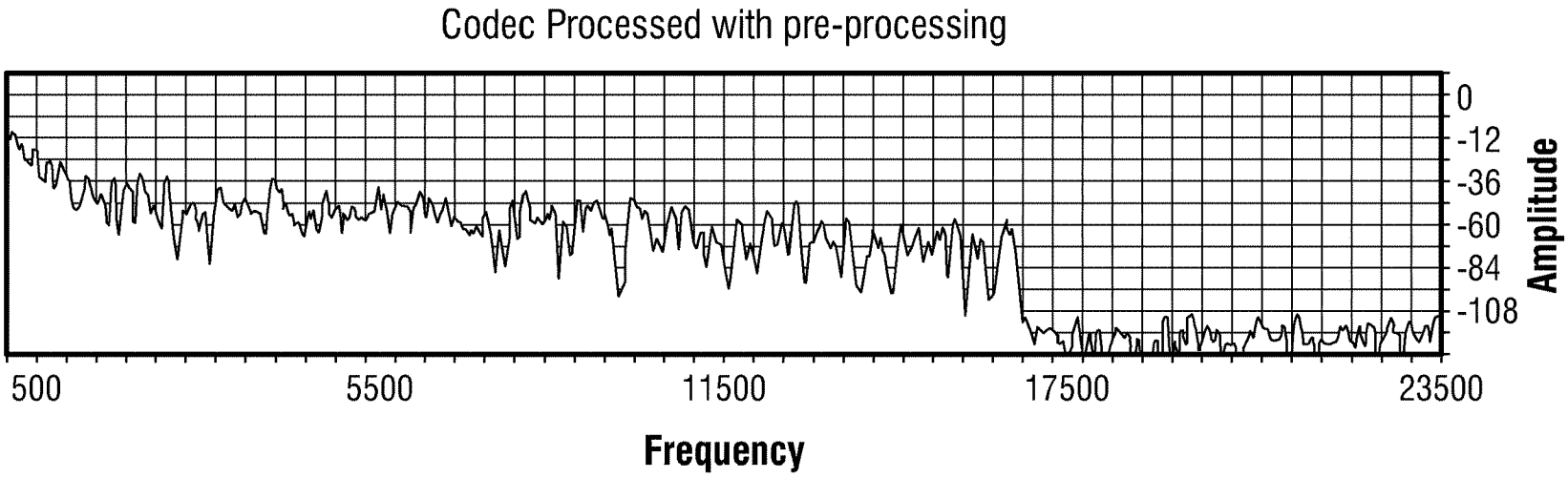
FIG. 11 is a magnitude spectrum of a codec-processed version of the original signal of FIG. 9, with pre-processing of the original signal.

FIG. 9 is a graph of the magnitude spectrum of an example, original input audio signal in a 48 kHz sample rate WAV format, which may be for example the L or R channel in the embodiment of FIG. 7. The complete spectrum has significant frequency components up to about 16 kHz. FIG. 10 is a magnitude spectrum of a "naked" codec-processed version of the original input audio signal of FIG. 9, without the signal enhancement pre-processing described above being applied (to the original input audio signal as depicted in FIG. 8). Note how, as seen in FIG. 10, there is significant suppression of frequency components above 6500 Hz. FIG. 11 is a magnitude spectrum of a codec-processed version (same codec as used for FIG. 10) of a pre-processed version of the original input audio signal of FIG. 9, with pre-processing performed according to the techniques described above. It can be seen how this codec-processed version has significant frequency components between 6500 Hz and 17 kHz. Thus, the pre-processing of the input audio signal, in accordance with the signal enhancement techniques described above, has prevented suppression of the higher frequency components in the subsequently codec-processed version, thereby resulting in an output audio signal having enhanced realism.

As explained above, an embodiment of the invention may be a digital signal processing method that includes operations such as all-pass filtering, scaling, combining (e.g., summing), envelope detection, and time-variation of the all-pass filtering. Such operations may be performed entirely by a programmed processor, programmed in accordance with the structural algorithms or procedures described above. Another embodiment of the invention is a machine-readable medium (such as microelectronic memory) having stored therein instructions that program one or more data processing components (generically referred to here as "a processor") to perform the structural digital signal processing operations described above. Such instructions may be part of a media server application program, or a media client/player application program. In other embodiments, some of those operations might be performed by specific hardwired circuit components that contain hardwired logic (e.g., dedicated digital filter blocks, state machines). Those operations might alternatively be performed by any combination of programmed data processing components and hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, in FIG. 7, although the summing unit 5 is shown as having three inputs that are connected to three paths, respectively, originating from the same input audio signal (L or R channel), the summing unit 5 may also have additional inputs that are connected to other signal processing paths that originate from the same input audio signal (L or R channel), so as to provide additional conditioning to the output audio signal. As an example, there may be a bass enhancement path, and a tube simulator path (in addition to the all-pass block paths shown in FIG. 7.) The description is thus to be regarded as illustrative instead of limiting.

What is claimed is:

1. A digital signal processing method for enhancing realism of an input audio signal, comprising:

a. filtering an input audio signal using an all-pass filter, to produce an all-pass filtered version;

b. scaling the all-pass filtered version to produce a scaled, all-pass filtered version;

c. combining the scaled, all-pass filtered version with the input audio signal, to form an output audio signal;

d. detecting envelope of the input audio signal, while performing the filtering in a., the scaling in b., and the combining in c.; and e. altering the all-pass filter as a function of the detected envelope of the input audio signal.

2. The method of claim 1 wherein the all-pass filter comprises a. a filter input;

b. a filter output;

c. a summing junction having i. a first input to receive an un-delayed version of the filter input, ii. a second input to receive a delayed version of the filter input, and iii. a third input to receive a delayed version of the filter output.

3. The method of claim 2 wherein altering the all-pass filter comprises a. changing a first delay, being a number of samples by which the delayed version of the filter input is delayed.

4. The method of claim 3 wherein the first delay varies, between a minimum delay and a maximum delay, in proportion to the detected envelope of the input audio signal so that the delay becomes longer in proportion to the detected envelope increasing, shorter in proportion to the detected envelope decreasing.

5. The method of any one of the previous claims wherein detecting envelope of the input audio signal comprises computing a moving average of an amplitude of the input audio signal, wherein the detected envelope is updated as the moving average, at a rate of between every sample to every ten samples of the input audio signal.

6. The method of any one of claims 2-5 wherein the all-pass filter comprises a. a feedback gain applied to the delayed version of the filter output at the third input of the summing junction, and wherein altering the all-pass filter comprises changing the feedback gain in proportion to the detected envelope of the input audio signal.

7. The method of claim 6 wherein changing the feedback gain in proportion to the detected envelope of the input audio signal comprises:

increasing the feedback gain responsive to the detected envelope increasing, and decreasing the feedback gain responsive to the detected envelope decreasing.

8. The method of any one of the previous claims further comprising low pass filtering the input audio signal to produce a low pass filtered version, wherein filtering the input audio signal using the all-pass filter comprises filtering the low pass filtered version.

9. The method of any one of the previous claims further comprising encoding the output audio signal using a lossy compression algorithm.

10. The method of any one of claims 1-8 further comprising converting the output audio signal into sound.

11. A digital audio signal processor configured to process an input audio signal for enhancing its realism, comprising:

a. an all-pass filter having an input to receive an input audio signal, and a control input through which phase response of the all-pass filter is varied;

b. a gain element having an input coupled to an output of the all-pass filter;

c. a summing unit having a first input coupled to an output of the gain element, a second input to receive the input audio signal which bypasses the all-pass filter and the gain element; and d. a modulation generator having an input to receive the input audio signal which bypasses the all-pass filter and the gain element, wherein the modulation generator has an output coupled to the control input of the all-pass filter.

12. The processor of claim 11 wherein the modulation generator comprises an envelope follower, and the all-pass filter comprises a. a filter input;

b. a filter output;

c. a summing junction having i. a first input to receive an un-delayed version of a signal from the filter input, ii. a second input to receive a delayed version of the signal from the filter input, and iii. a third input to receive a delayed version of a signal from the filter output.

13. The processor of claim 12 wherein the control input of the all-pass filter is to change a first delay, being a number of samples by which the delayed version of the signal from the filter input is delayed.

14. The processor of claim 13 wherein the first delay varies, between a minimum delay and a maximum delay, in proportion to envelope of the input audio signal so that the delay becomes longer in proportion to the envelope increasing, shorter in proportion to the envelope decreasing.

15. The processor of any one of claims 12-14 wherein the envelope follower repeatedly computes a moving average of amplitude of the input audio signal, at a rate of between every sample to every ten samples of the input audio signal.

16. The processor of any one of claims 12-15 wherein the all-pass filter comprises a. a feedback path gain element that applies a scalar gain to the delayed version of the signal from the filter output, at the third input of the summing junction, wherein the scalar gain changes in proportion to the envelope of the input audio signal.

17. The processor of any one of claims 11-16 further comprising a low pass filter having an input to receive the input audio signal and an output feeding the input of the all-pass filter.

18. The processor of any one of claims 11-17 in combination with an audio encoder that implements a lossy compression algorithm and that has an input coupled to an output of the summing unit.

19. The processor of any one of claims 11-17 in combination with a sound system that converts an output audio signal from an output of the summing unit into sound.

20. An article of manufacture comprising:

a non-transitory machine-readable medium having stored therein instructions that when executed by a processor a. filter an input audio signal using an all-pass filter, to produce an all-pass filtered version;

b. scale the all-pass filtered version to produce a scaled, all-pass filtered version;

c. combine the scaled, all-pass filtered version with the input audio signal, to form an output audio signal;

d. detect envelope of the input audio signal, while performing the filtering in a., the scaling in b., and the combining in c.; and e. alter the all-pass filter as a function of the detected envelope of the input audio signal, while performing the filtering in a., the scaling in b., and the combining in c.

21. The article of manufacture of claim 20 wherein the machine-readable has stored therein instructions that configure the all-pass filter to comprise a. a filter input;

b. a filter output;

c. a summing junction having i. a first input to receive an un-delayed version of the filter input, ii. a second input to receive a delayed version of the filter input, and iii. a third input to receive a delayed version of the filter output.

* * * * *